United States Patent [19]

Sabota et al.

[11] Patent Number: 4,534,291

[45] Date of Patent: Aug. 13, 1985

[54] METHOD AND APPARATUS FOR CLEANING PRINTING PRESSES

[76] Inventors: James J. Sabota, 15849 Sylvia Dr., Brook Park, Ohio 44142; William G. Bradshaw, 7340 Martingale, Chesterland, Ohio 44026

[21] Appl. No.: 103,194

[22] Filed: Dec. 13, 1979

[51] Int. Cl.[3] ..... B41F 31/06; B41L 27/08

[52] U.S. Cl. ..... 101/426; 101/207; 101/364; 101/425

[58] Field of Search ..... 101/425, 423, 366, 148, 101/364, 363, 207, 208, 210; 137/239; 118/302, 104, 203; 15/256.5, 256.51, 256.52

[56] References Cited

U.S. PATENT DOCUMENTS

| | | | |
|---|---|---|---|
| 312,158 | 2/1885 | Peeney | 137/239 |
| 603,465 | 5/1898 | Dredge et al. | 137/239 |
| 2,039,006 | 4/1936 | Jasper | 137/239 X |
| 2,109,896 | 3/1938 | Anderson et al. | 137/239 X |
| 2,184,618 | 12/1939 | Lawlor | 137/239 X |
| 2,827,070 | 3/1958 | Gatz | 137/239 |
| 3,658,003 | 4/1972 | Johnson | 101/425 X |
| 3,800,702 | 4/1974 | Roberts | 101/425 |
| 3,896,730 | 7/1975 | Garrett et al. | 101/425 |
| 3,974,768 | 8/1976 | Grobman | 101/425 |
| 4,175,489 | 11/1979 | Gattus | 101/425 X |

*Primary Examiner*—J. Reed Fisher

*Attorney, Agent, or Firm*—Pearne, Gordon, Sessions, McCoy, Granger & Tilberry

[57] ABSTRACT

A method and apparatus are provided for washing elements of a printing press. In accordance with the method, the press and the ink supply pump are operated during the washing operation. Wash liquid is delivered to the press fountain and passed through the press in a cocurrent ink flow direction while effecting washing of those elements of the press normally contacted with ink. Wash liquid is also passed in a countercurrent ink flow direction through the ink supply line, and an ink filter if present, and introduced into the ink pump through its discharge line while it is being operated in order to wash the internal surfaces of the pump and ink supply line as well as the filter, if present. Wash liquid is also applied to the external surfaces of the pump. In all cases, the wash liquid is discharged after a single washing contact without recirculation. The apparatus includes an electronic control for automatically actuating liquid flow control valves and a pump for injecting solvent or detergent into the wash liquid and a shower head for applying wash liquid to the external surface of the pump, together with suitable conduits for delivery of the wash liquid to the press.

28 Claims, 7 Drawing Figures

METHOD AND APPARATUS FOR CLEANING PRINTING PRESSES

BACKGROUND OF THE INVENTION

The present invention relates generally to the cleaning of printing press apparatus and more paticularly to an automatic cleaning system for portions of the printing press apparatus.

The flexographic printing press apparatus used in the corrugated paperboard container industry is illustrative of the printing press apparatus and cleaning problems of concern herein. In such flexographic printing press sytems, an ink supply system including a pump delivers ink to an ink fountain defined by two cooperating rolls, or a single fountain roller and a doctor blade, which in turn transfers the ink to a printing plate roller which carries a printing die. The ink is pumped from a remote source or container thereof through suitable conduits to the fountain, and excess ink spilling from the edges of the fountain falls into collecting pans for return through an ink return system to the ink container. In some instances, an ink filter is disposed between the pump and the fountain, and an overflow of ink from the filter is returned to the ink source for assuring circulation of the ink within the container to inhibit the drying and/or settling of the ink therein during the printing operation.

The prior art discloses a number of automatic printing press cleaning systems such as that shown in U.S. Pat. No. 3,896,730, which includes the use of both spray nozzles for directing a water wash onto various press rolls and the delivery of wash water to the fountain while the press is being operated during the cleaning operation. In this press, the ink is pumped from a container to a gravity feed reservoir and, during washing, the wash water is collected in the container and recirculated through the use of the ink pump to the gravity feed reservoir for delivery to the fountain. The use of wash liquid sprays in a cleaning system is also disclosed in U.S. Pat. No. 3,800,702. In this instance, the sprays of wash liquid are directed onto various rolls of the press, as well as onto the inside surfaces of a gravity feed ink reservoir. The wash liquid is recirculated to the gravity feed reservoir through the use of the ink pump, and both a wash and a rinse cycle are employed. A cleaning system is disclosed in U.S. Pat. No. 3,974,768 for flexographic printing presses having a dual ink delivery and circulation system. In this patent, wash liquid is separately delivered to the fountain and the collecting pans, which normally receive spillover ink from the fountain, and no provision is made for the washing of the ink pump.

The teachings of the foregoing prior art patents may be characterized as generally providing wash liquid to the press fountain, flowing the wash liquid downstream from the fountain in a cocurrent ink flow direction using the press ink distribution system, and, in some cases, using the ink pump to recirculate wash liquid returned by the ink return system of the press in order to wash the pump and the ink supply means upstream of the fountain. A prior art cleaning system developed by the applicants herein includes delivery of wash liquid to the fountain for flow in a cocurrent ink flow direction and the delivery of wash liquid to the ink supply means in a countercurrent ink flow direction for reverse flow washing through the ink supply means and the pump.

SUMMARY OF THE INVENTION

A method and apparatus are provided for cleaning or washing printing press apparatus. In accordance with the method, the press including the ink pump is operated during the washing operation. The elements of the press to be washed are contacted with wash liquid flowing in either a cocurrent ink flow direction or a countercurrent ink flow direction, and the wash liquid is discharged after a single washing contact without recirculation. Wash liquid is also applied to the external surfaces of the ink pump without recirculation. The wash liquid may include a solvent or detergent, and the washing operation may include a wash cycle with wash liquid containing solvent and a subsequent rinse cycle with wash liquid but no solvent. The apparatus includes an electronic control for actuation of wash liquid flow control valves and ink distribution elements of the press, together with suitable conduits and a shower head or ring for delivery of wash liquid to the press and the ink pump in an automatic washing operation.

In the illustrated embodiments, the press includes a plurality of printing sections or color stations which are selectively washed. The particular color station to be washed is separated from the press, and its associated ink pump is placed over a suitable drainage grate or waste collection device. The wash liquid is delivered to the fountain for distribution downstream of the fountain in cocurrent ink flow direction while the driven fountain roller is being operated and discharged through the ink return system while effecting washing of the elements of the press contacted by the wash liquid. Wash liquid is also passed in a countercurrent ink flow direction through the ink supply means upstream from the fountain, including the pump while it is being operated, and discharged after effecting washing of those elements of the press which are contacted by the wash liquid. Concurrently, wash liquid is applied to the external surface of the pump by a shower head or ring and directly discharged after effecting washing of the surface. The latter is conveniently provided through the use of an in-line ink filter and the overflow return line therefrom. More particularly, the countercurrent flow of wash liquid is sufficient to cause reverse flow through the operating pump, the filling of the in-line filter, and the flow of wash liquid through the filter return line to the shower head located above the surface of the pump which is normally submerged in ink during the printing operation. If an ink filter is not used in the particular press being washed, a tee is simply inserted in the ink supply line from the pump for dividing the countercurrent flow of wash liquid between the internal and external surfaces of the pump. Alternatively, wash liquid may be supplied directly to the shower head through a separate conduit whether or not an in-line ink filter is present in the ink supply line of the particular press.

The wash liquid is provided by the use of an available plant water supply or other source of water under pressure, and the washing system provides for the injection of solvent into the water to provide the wash liquid during a first cycle of the washing operation. The injection of solvent is terminated to provide a subsequent rinse cycle in the washing operation. Accordingly, the electronic control incorporates suitable timing relays for regulating the flow of wash liquid, the injection of solvent and the operation of the press during the washing operation.

In contrast with the prior art methods and apparatus, the present invention efficiently utilizes the ink distribution system of the operating press to apply wash liquid to the press fountain and downstream press elements in a cocurrent ink flow direction without recirculation of the wash liquid. Through the flow of wash liquid in a countercurrent ink flow direction, the press elements upstream of the fountain, including the internal surfaces of the ink pump, are also efficiently washed without recirculation. The external surfaces of the pump are directly contacted with wash liquid, which is also discharged without recirculation. It is believed that the avoidance of recirculation together with concurrent washing of both the external and internal surfaces of the ink pump are primarily responsible for the rapid wash cycle and minimization of wash liquid usage in the subject washing operation. For example, a typical washing operation employs about ten gallons of wash liquid and a two-minute wash time, including both wash and rinse cycles.

The washing technique also enables the provision of an economical wash apparatus, which to a large degree is provided by the use of existing conduits and other ink distribution elements for direct application of the wash liquid. The control elements of the electronic control are commercially available and adaptable for use in the washing apparatus without special modifications.

DETAILED DESCRIPTION OF THE DRAWINGS

Figure 1:
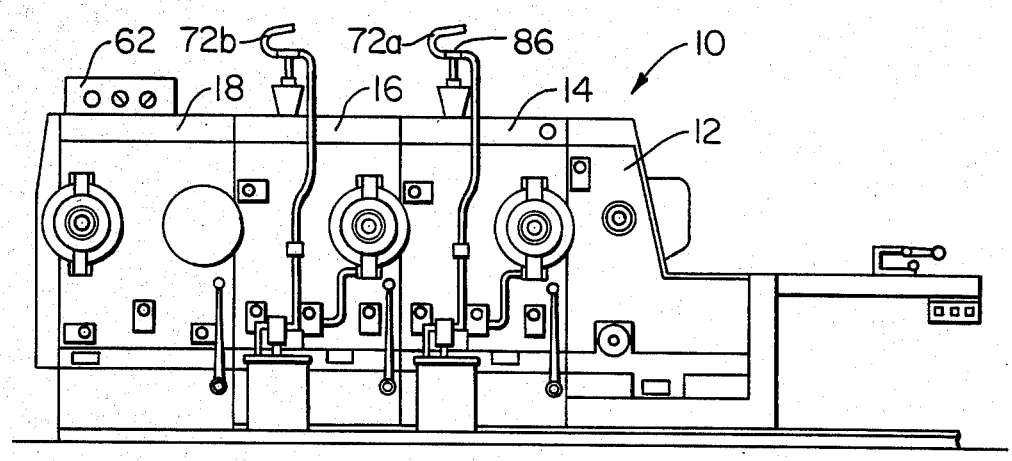
FIG. 1 is a side elevational view of a printing press having a cleaning system or washing apparatus in accordance with the present invention.

Referring to FIG. 1, there is shown a printing press 10 in the form of a printer slotter which enables printing and the creasing and slotting of paperboard stock to produce a printed box blank. The press 10 includes a feed section 12, a first printing section or color station 14, a second printing section or color station 16, and a slotter section 18. The color stations 14 and 16 are separable from one another as well as the other sections of the press 10 in order to permit access by an operator. The printing operation is provided by each of the color stations 14 and 16, which are substantially identical in construction. For purposes of convenience, the cleaning system is described in connection with the color station 14.

Figure 2:
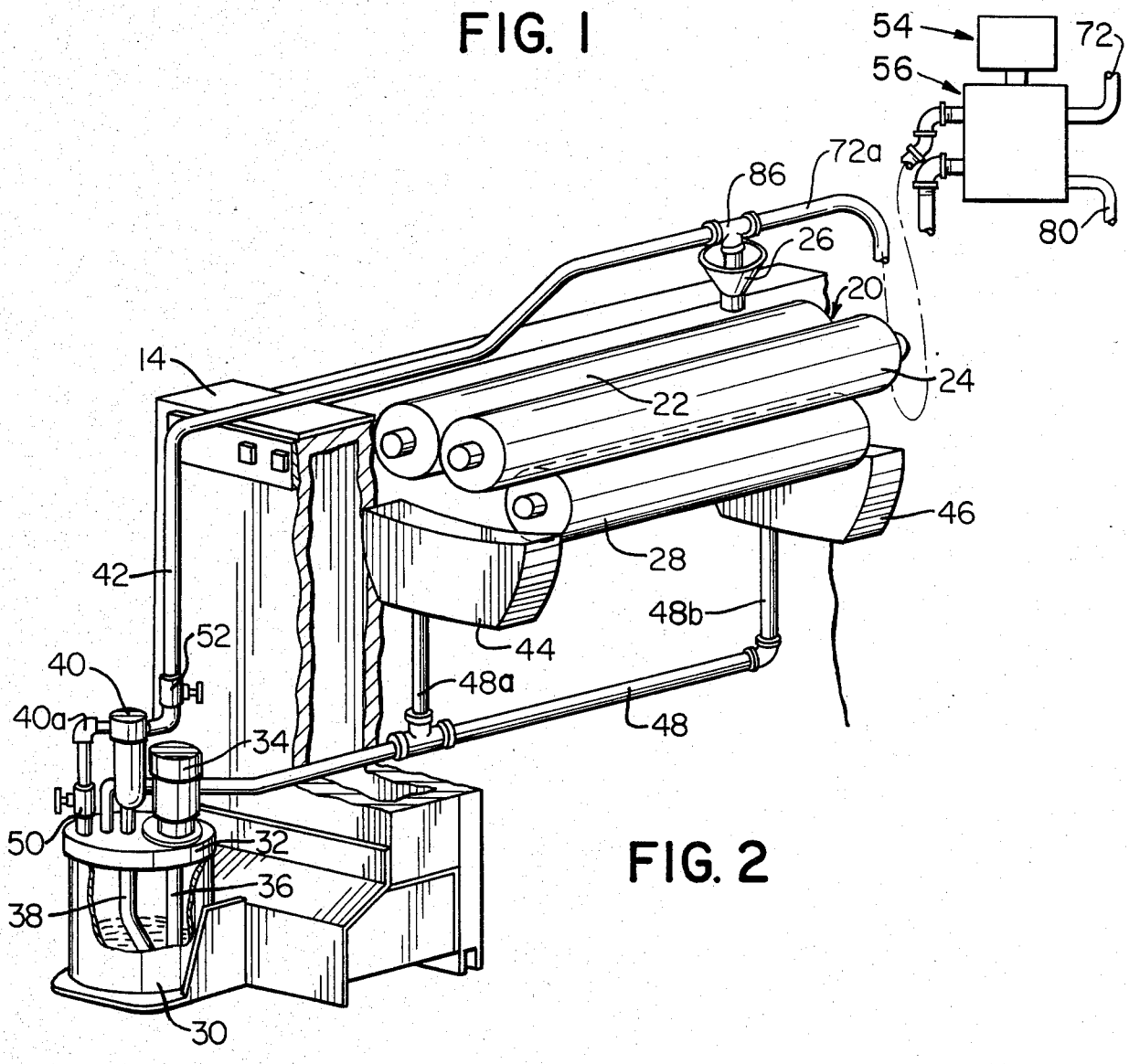
FIG. 2 is a perspective view, on an enlarged scale, of a portion of the press showing the washing apparatus.
Figure 3:
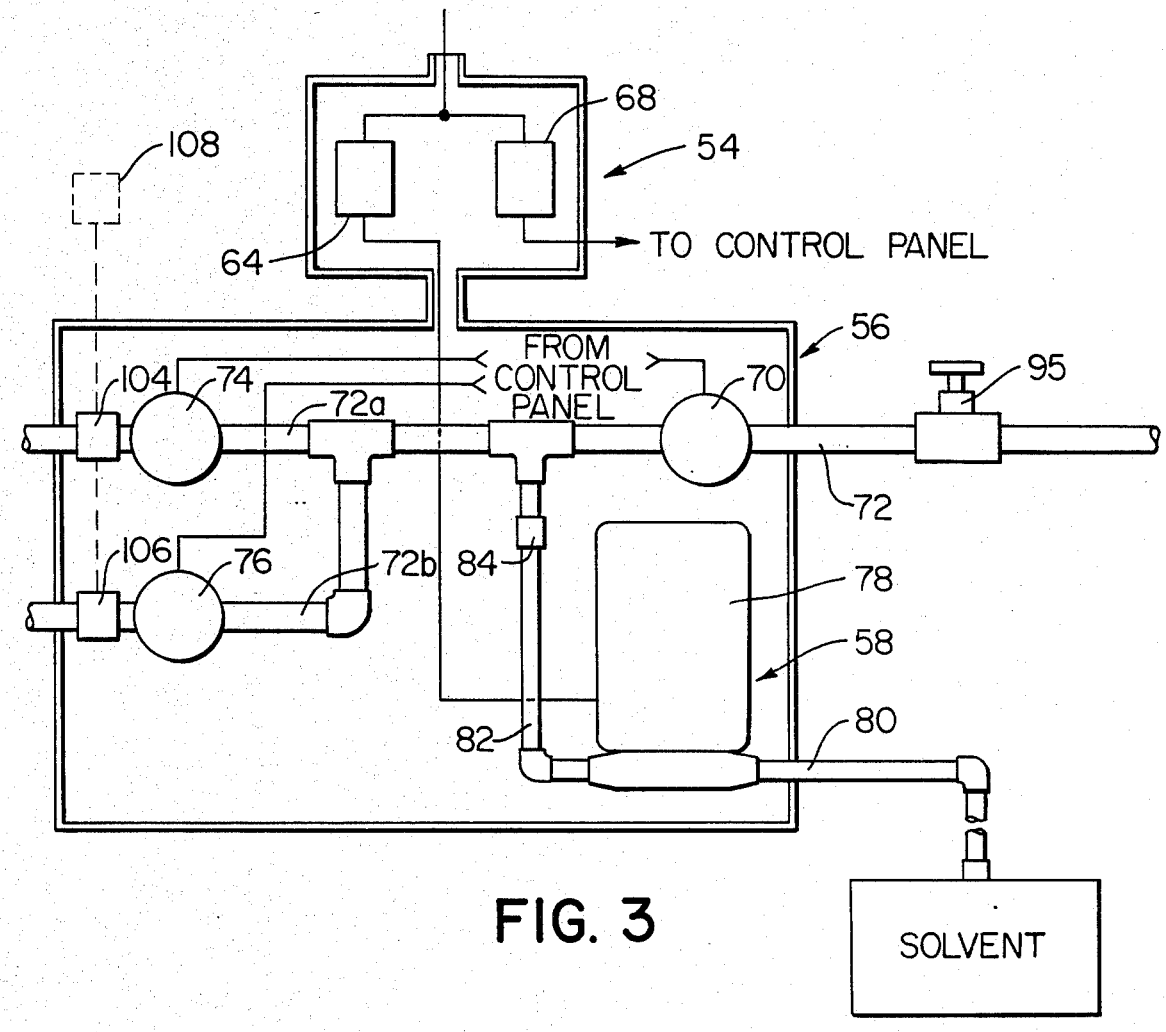
FIG. 3 is a diagrammatic, front elevational view, on an enlarged scale, of an electronic control system, a wash liquid flow control unit, and a solvent injector of the washing apparatus.

Referring to FIG. 2, the color station 14 includes a fountain 20 provided by a pair of fountain rollers 22 and 24 rotatably mounted to a portion of the frame of the color station. A printing medium such as water-soluble ink is introduced into the fountain 20 through a feed funnel 26 and transferred by the fountain roller 24 to a printing plate roller 28 (shown in phantom outline) which is adapted to carry a printing die. The roller 22 is driven and serves to drive the roller 24 while delivering a metered amount of ink thereto for transfer to the printing die carried by the roller 28.

A supply of ink is maintained in a container 30 for delivery to the feed funnel 26. To that end, the container 30 includes a removable lid 32 having a motor 34 mounted thereto. The motor 34 is integrally mounted through the lid 32 to an ink pump 36 having an intake disposed below the level of the ink in the container 30. The output of the pump 36 is passed through discharge line 38 to an ink filter 40. The filtered ink passes from the filter 40 through an ink supply line or conduit 42, which delivers the ink through the feed funnel 26.

The excess ink delivered to the feed funnel 26 and fountain 20 flows from the opposite edges of the fountain into collector pans 44 and 46. The collector pans 44, 46 cooperate with ink return line or conduit 48 having branch lines 48*a* and 48*b* to provide an ink return system which delivers the excess ink to the container 30.

The use of an ink filter 40 is optional and, if an ink filter is not used, the discharge line 38 of the pump 36 is directly connected to the line 42 for delivery of ink to the funnel 26. When an ink filter is used, it is also convenient to provide an ink filter return line 40*a* which serves to recirculate a portion of the ink delivered to the filter 40 to the container 30 to inhibit the drying and/or settling of the ink therein during the printing operation. To that end, a flow regulator valve 50 is disposed in the line 40*a*, and a similar flow regulator valve 52 is disposed in the line 42. The valves 50, 52 are initially adjusted by the operator during the printing operation to assure a sufficient flow of ink to the funnel 26 and also to provide a relatively minor return flow of ink through the line 40*a*. The flow of ink through the line 40*a* is regulated to assure adequate recirculation without aeration of the ink which results from unduly high flow rates. Alternatively, external clamps (not shown) may be used instead of the valves 50 and 52 in order to adjustably compress the flexible lines 40*a* and 42 and regulate the flows therethrough.

Referring to FIGS. 2 to 6, the cleaning system for the press 10 includes an electronic control 54, a wash liquid flow control unit 56 connected to a source of wash liquid under pressure, such as a plant water supply, a solvent or detergent injector 58 connected to a source of solvent, and a shower head 60 together with suitable flow conduits or lines including portions of the press ink distribution system as described in detail below. The cleaning system is selectively used by an operator to clean color stations 14 and 16 through the use of control panel 62, which may be mounted on the slotter 18, as shown in FIG. 1.

The electronic control 54 includes timing relays 64 and 68, which are arranged to control the flow of wash liquid and the operation of the press during the washing operation. To that end, the wash liquid flow control unit 56 includes a solenoid valve 70 in the incoming wash liquid or water supply line 72, and solenoid valves 74 and 76, respectively disposed in branch lines 72*a* and 72*b* of the main supply line 72. The solenoid valves 70, 74, and 76 are arranged to regulate the flow of liquids in a conventional manner under the control of timing relay 68. The timing relay 68 also controls the operation of the appropriate elements of the selected color station during the washing operation. The relay 68 operates through the control panel 62 to energize the appropriate solenoid valve 74 or 76, as well as the solenoid valve 70, and to cause the operation of the color station 14 or 16. The addition of solvent by the solvent injector 58 to the liquid flowing in the line 72 is controlled by the timing relay 64. Accordingly, the solvent injector 58 includes an electrically driven, self-priming pump 78 having its intake connected to a supply of solvent via line 80 and its output connected to line 72 via line 82 having an in-line one-way valve 84 disposed therein.

The timing relays 64 and 68 are of conventional design and they are used in a known manner to control the operation of the pump 78 and the solenoid valves 70, 74 and 76 as well as the pump 36 and the fountain roller 22. Suitable timing relays are marketed by Dayton Electric Manufacturing Company under Model Nos. 6X153 and 6X154, the former having an adjustable timing period up to about 10 seconds and the latter having an adjustable timing period up to about 3 minutes. The Dayton Electric Manufacturing Company also distributes a suitable pump for use in the solvent injector 58 under the brand name Teel and Model No. P 579C. For use in water-soluble ink systems, a suitable solvent or detergent is distributed by the Amway Corporation under the brand name LOC.

The timing relay 64 is arranged to cause the pump 78 to be operated for a predetermined cycle during which solvent is injected into the liquid flowing in line 72. Concurrently therewith, the timing relay 68 operates to permit flow through the solenoid valve 70 and the solenoid valve 74. The timing relay 68 also causes the ink pump 36 and the fountain roller 22 to be actuated during the washing operation. Accordingly, during a first predetermined cycle of the washing operation, all of the relays cooperate to deliver wash liquid including solvent to the color station 14 and to operate the fountain rollers and ink pump of the color station. At the end of the first cycle, the timing out of the relay 64 de-energizes the pump 78 and the injection of solvent into the wash liquid stops. The timing relay 68 continues to pass wash liquid to the color station 14 in order to provide a rinse cycle. Thereafter, the relay 68 also times out so as to stop the flow of wash liquid, as well as the operation of the color station and the ink pump associated therewith. In typical applications, the first wash cycle is about ten to twenty seconds in duration, and the rinse cycle is about one-and-one-half to two minutes long. In accordance with the difficulty of the particular cleaning operation, the cycles can be increased or decreased by simply adjusting the time periods of the appropriate timing relays. Generally, the total washing operation, including both the wash and rinse cycle, is about two minutes long.

The wash liquid delivered to the color station 14 through line 72*a* is divided by means of tee 86 (FIGS. 1 and 2), a portion of the wash liquid passing through the funnel 26 to the fountain 20, and the remaining portion of the wash liquid flowing into line 42. The wash liquid flowing in the line 42 passes into the filter 40 so as to flood and backwash the filter. Accordingly, a portion of the wash liquid passes from the filter 40 through the pump discharge line 38 and enters the lower portion of the pump housing. The operation of the pump serves to distribute the wash liquid over the internal surfaces of the pump, as well as the rotating impeller 36*a*, so as to effectively wash all of the internal surfaces of the pump. The wash liquid is then discharged through intake port 36*b* of the pump adjacent the bottom of the pump housing.

The portion of the wash liquid delivered to the filter 40 which does not exit through the line 38 passes through the ink filter return line 40*a* and into the shower head 60. The shower head 60 is connected by a tee 88 to the line 40*a*, and comprises a continuous conduit 90 having perforations or apertures 92 for spraying the wash liquid onto the external surfaces of the pump 36. The conduit 90 is mounted to the lid 32 of the container 30 by means of brackets 94.

Figure 6:
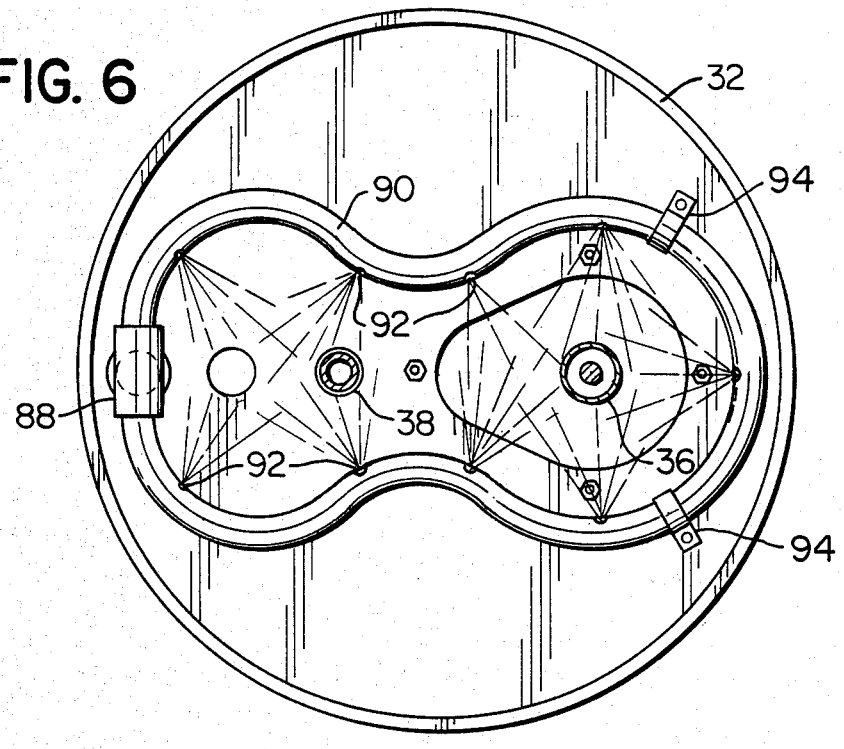
FIG. 6 is a sectional view, taken along the line 5—5 of FIG. 5.

As most clearly shown in FIG. 6, the conduit 90 is provided with a suitable circuitous configuration to assure that the wash liquid is sprayed on all of the external surfaces of the pump, including both the pump housing and the discharge line 38. In the illustrated embodiment, the conduit 90 is provided with a "figure 8" configuration to assure that all of the external surfaces of the pump which are normally submerged in ink within the container 30 are washed. Similarly, the disposition of the conduit 90 adjacent the lid 32 serves not only to contain the shower of wash liquid, but also to assure that the wash liquid flows downwardly along the lower, normally ink-submerged pump surfaces.

It should be appreciated that the flow of wash liquid through the shower head 60 is sufficiently greater than the flow of ink during the printing operation so as to ensure the spraying impingement of wash liquid on the external pump surfaces without adjustment of the valves 50 and 52. In contrast with the spray of wash liquid for cleaning purposes, the ink does not spray or jet from the apertures 92 during printing but, rather, the ink tends to spill through the apertures into the container 30. This result is achieved by regulation of the water supply to the wash liquid flow control unit 56 through the use of a flow control valve 95 disposed in the line 72. Typically, the plant water supply to which line 72 is connected will provide a flow of water greater than that needed in the cleaning system and valve 95 restricts the flow of water. The lower viscosity of the wash liquid as compared with the ink also tends to promote the desired wash liquid and ink flows through the shower head 60.

Figure 5:
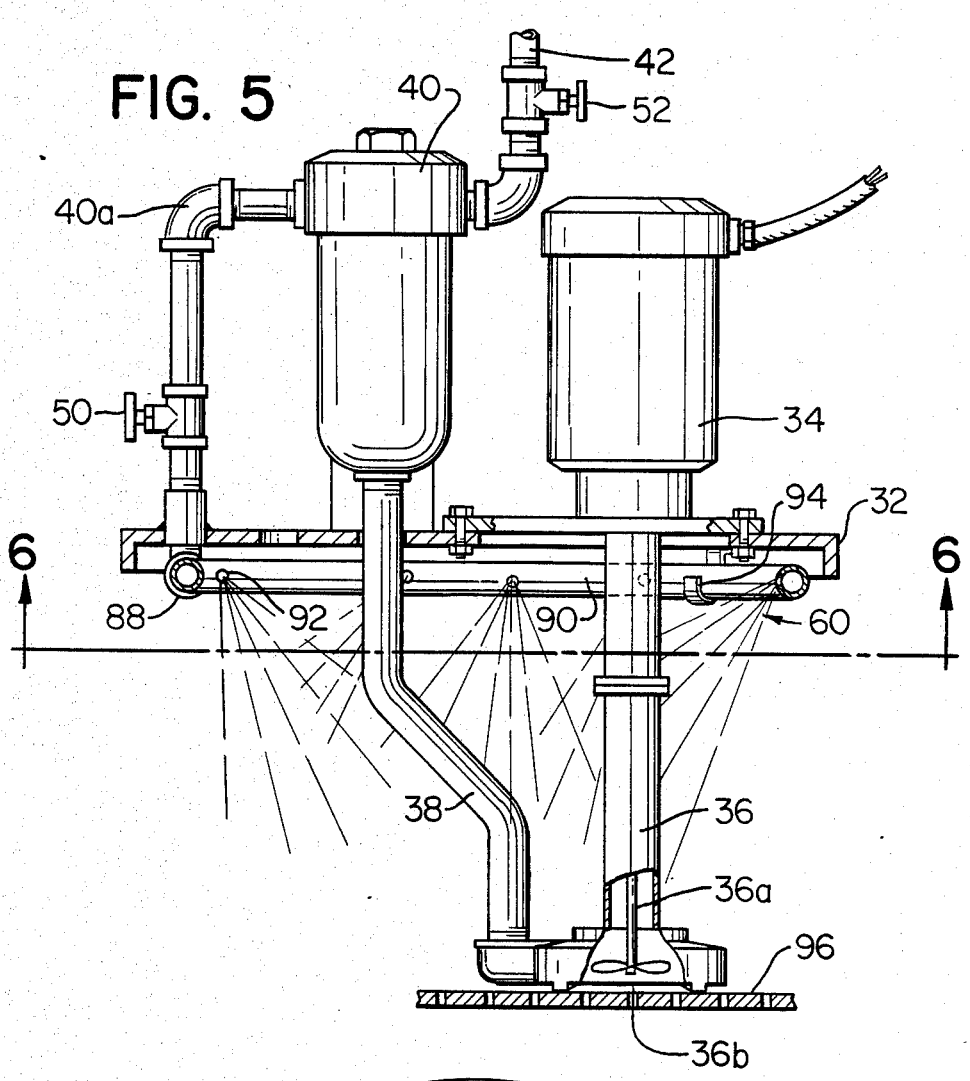
FIG. 5 is a side elevational view on an enlarged scale, showing a shower ring for washing the external surface of the ink pump.

In the cleaning operation, the color station 14 is initially separated from the press 10 to allow the removal of the printing die from the printing plate roller 28 for separate cleaning and storage thereof. The line 48 is disconnected from the lid 32 of the container 30 and is connected to a drain or suitable waste collection device, such as the drain covered by drainage grate 96 (FIG. 5). The pump 36, together with the integral motor 34, the lid 32, and the filter 40, is then removed from the ink container 30 and placed over the drainage grate 96 in an upright position without disconnecting the line 42, which is sufficiently flexible to allow for the movement of the pump 36 and associated apparatus.

Figure 4:
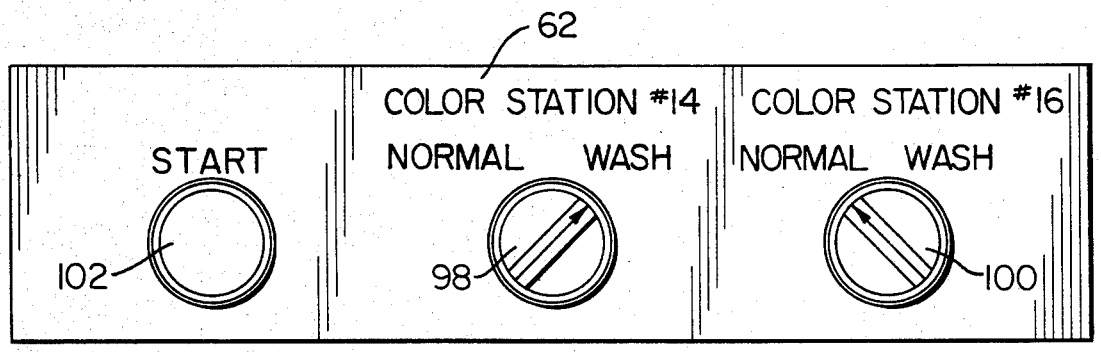
FIG. 4 is a front elevational view on an enlarged scale, showing a control panel for the washing apparatus.

The selector switch 98 associated with the color station 14 on the control panel 62 is then moved from the normal printing mode operation to the wash position, as shown in FIG. 4. The selector switch 100 associated with the color station 16 is left in a normal printing mode position at this time. The start button 102 is then pressed in order to energize the timing relays 64 and 68, as discussed above. The solvent is injected into the wash liquid during the initial wash cycle, and the wash liquid is delivered to the color station 14 through the line 72*a*. A portion of the wash liquid passes through the funnel 26 and into the fountain 20 and the rollers 22 and 24 are washed as they rotate. Wash liquid flows from the fountain 20 in the collector pans 44 and 46 and through the ink return lines 48*a*, 48*b*, and 48 for discharge through the drainage grate 96 after washing the foregoing elements of the ink return system. The remaining portion of the wash liquid delivered to the color station 14 passes with concurrent washing through the line 42 and the filter 40 wherein the flow is divided between line 38 and 40*a*. The flow of wash liquid through the line 38 into the housing of the pump 36 and the flow of wash liquid through the line 40*a* to the shower head 60 provides simultaneous washing of both the internal and external surfaces of the pump, which are generally ink-covered. The wash liquid draining from the internal and external surfaces of the pump 36 passes directly through the grate 96.

The relay 64 de-energizes the pump 78 at the end of the wash cycle, while relay 68 maintains the solenoid valves 70, 74 in an open condition, allowing for the continued flow of wash liquid and operation of the press during rinse cycle. At the end of the wash cycle, the relay 68 cooperates to close the solenoid valves 70, 74 and to stop the operation of the rollers 22, 24 and the ink pump 36. The solenoid valve 70 serves is a backup shut-off valve if, for any reason, the valve 74 fails to close. Upon completion of the washing operation, the color station 14 is returned to the press after the printing die 28 has been replaced. The color station 16 may then be washed by returning the selector switch 98 to the normal position and moving the selector switch 100 to the wash position.

It should be appreciated that the timing relay 68 can be arranged to concurrently or collectively operate the solenoid valves 70, 74 and 76, and the color stations 14 and 16 to allow for the simultaneous cleaning of both of the color stations. This would also require modification of the control unit 56, solvent injector 58 and associated flow lines to provide about double the supply of wash liquid in order to maintain the same wash period. However, the relatively short period or cycle of the washing operation does not make simultaneous washing of the color stations particularly advantageous.

As indicated above, the relay 68 is used to control the delivery of wash liquid to the appropriate color station by operation of the solenoid valves 74 and 76 and also actuates the roller 22. This arrangement assures that wash liquid will be present in the fountain 20 in order to prevent the dry operation of the rollers 22, 24 and roller damage as a result thereof. In order to further ensure against any damage resulting from dry operation, flow-responsive valves 104 and 106 connected to a further timing relay 108 (FIG. 3) may be respectively inserted in lines 72*a* and 72*b* for controlling the passing of an energizing signal from the timing relay 108 to the relays 64 and 68. In this instance, the relay 108 would be included in the electronic control 54, and it would only pass an energizing signal to the relays 64, 68 if the flow of wash liquid was sensed by the valves 104 or 106. Suitable flow responsive valves are distributed under the brand name PEECO by the Power Engineering and Equipment Company of California.

Figure 7:
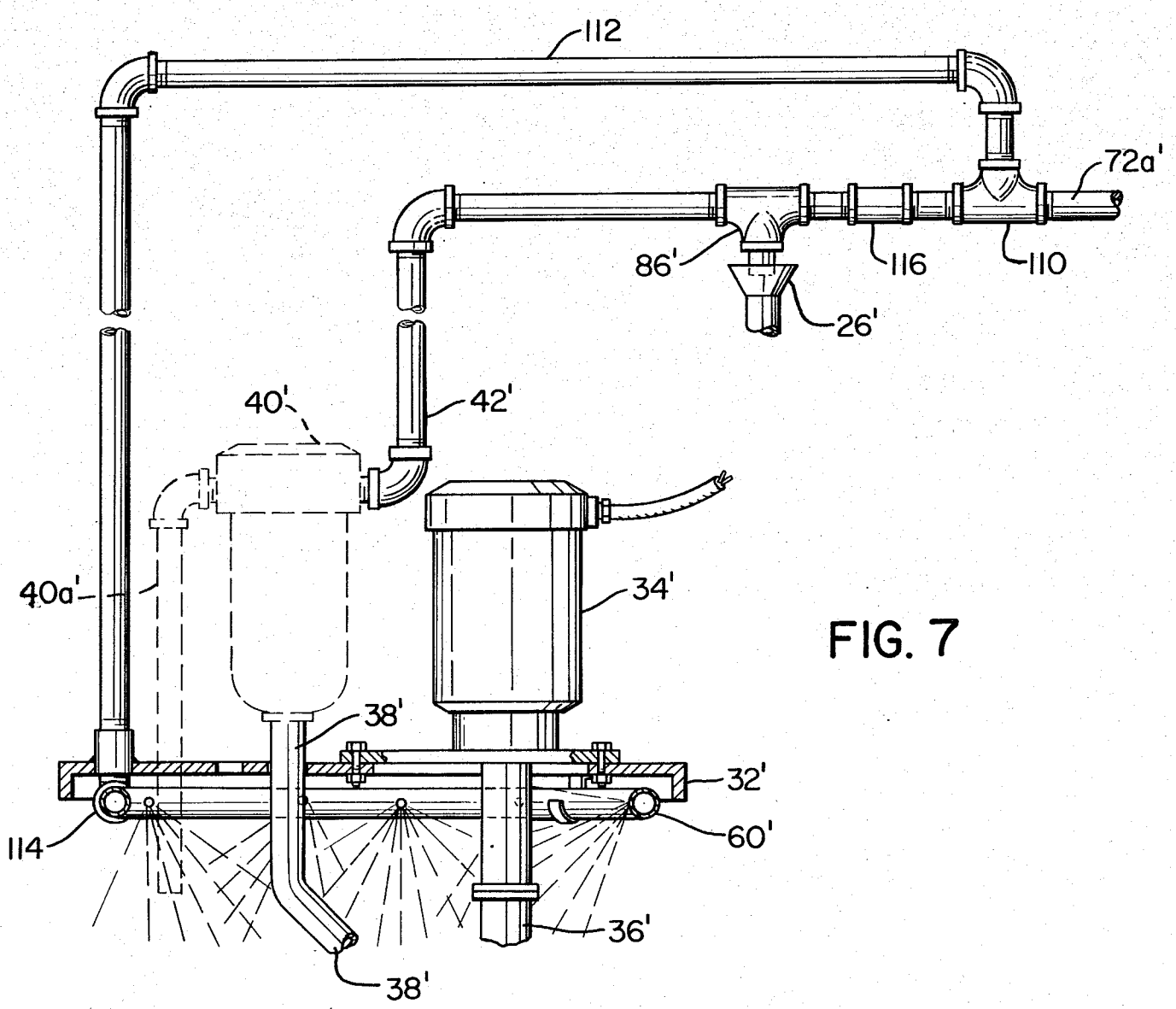
FIG. 7 is a side elevational view similar to FIG. 5 showing another embodiment of the cleaning system or washing apparatus in accordance with the present invention.

Referring to FIG. 7, a modified cleaning system is shown. For purposes of convenience, the corresponding elements of this cleaning system are identified with the same reference numerals as used above, with the addition of a prime designation.

As shown in FIG. 7, the wash liquid is separately delivered during the washing operation to a shower head 60' regardless of the presence of an ink filter 40', which is shown in phantom outline. To that end, a tee 110 is inserted in line 72*a'* upstream of tee 86' and a portion of the wash liquid is directly delivered to the shower head 60' through line 112, which is connected thereto by a tee 114. The proportion of wash liquid delivered to the shower head 60' is determined by the sizing of the line 112 and/or the use of flow restrictive valves in the line 112. The line 112, or at least a portion thereof, is sufficiently flexible to accommodate the movement of pump 36' together with integral motor 34' and lid 32' to a washing position over a drainage or waste collection device without disconnecting ink supply line 42'.

The cleaning system of FIG. 7 is the same as that described above, but for the separate delivery of wash liquid to the shower head 60'. Accordingly, wash liquid is also delivered to a feed funnel 26' and an ink supply line 42' during the washing operation. If the ink filter 40' is present, the wash liquid floods and backwashes the filter with a portion of the wash liquid passing from the filter through pump discharge line 38' to pump 36' and the remaining portion of the wash liquid being discharged through ink return line 40*a'*. If no ink filter is present in the particular press being washed, the ink supply line 42' is connected to the pump discharge line 38' and the wash liquid passes directly therethrough to the pump 36' during the washing operation.

In the cleaning system of FIG. 7, a check valve 116 is provided in the line 72*a'* immediately upstream of the tee 86'. The check valve 116 permits the flow of wash liquid to the tee 86', funnel 26', and ink supply line 42' during the washing operation and prevents the flow of ink into the line 72*a'* during the printing operation. The check valve 116 may also be used in the cleaning system shown in FIGS. 1 to 6, which otherwise relies upon the residual wash liquid in the line 72*a* to direct the flow of ink into the funnel 26 during the printing operation.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method of washing ink from elements of a printing press having an ink pump adapted to be at least partially submerged in a reservoir of ink and to deliver ink through conduit supply means to a press fountain operable to distribute ink during printing operation, collector pan means for receiving excess ink delivered to the fountain, and conduit return means connected to the collector pan means for removing excess ink therefrom during printing operation comprising a washing operation including;

(a) providing a source of wash liquid under pressure;

(b) disconnecting the ink pump from the reservoir of ink, (c) flowing a first stream of the wash liquid into the press fountain while operating the printing press to distribute the wash liquid and to collect the wash liquid in the collector pan means for removal through the conduit return means while effecting washing of the elements of the press by contact with the wash liquid;

(d) flowing a second stream of the wash liquid through the conduit supply means to the ink pump and through the ink pump in a countercurrent ink flow direction while operating the ink pump to wash internal surfaces of the conduit supply means and the pump, and (e) flowing a third stream of the wash liquid to shower head means for spraying the wash liquid onto the external surfaces of the pump which are normally submerged in ink during printing operation and washing the external surfaces by contact with the wash liquid.

2. A method as set forth in claim 1 including providing the third stream of wash liquid by direct flow from the source of wash liquid to the shower head means.

3. A method as set forth in claim 1, wherein the printing press includes an ink filter in the conduit supply means intermediate the ink pump and the press fountain, ink filter return line means adapted to return excess ink delivered to the filter to the ink reservoir during printing operation, and the step of flowing the third stream of wash liquid includes diverting a portion of the second stream of wash liquid delivered to the ink filter through the ink filter return line means to the shower head means.

4. A method as set forth in claims 1, 2 or 3 including flowing the first, second and third streams of wash liquid without recirculation thereof to wash the press fountain, the collector pan means, the conduit return means, the conduit supply means, and the internal and external surfaces of the ink pump.

5. A method as set forth in claim 3 wherein the conduit supply means and ink filter return line means include flow restriction means adjustable to cause a portion of the ink delivered to the ink filter by the ink pump to pass through the ink filter return line means and to return the ink to the reservoir through the shower head means without spraying during printing operation, and, during the washing operation, providing the diverted portion of the second stream of wash liquid at a flow sufficient to pass through the flow restriction means without further adjustment thereof and to assure the spraying of wash liquid through the shower head means.

6. A method as set forth in claim 1, wherein the step of spraying the external surfaces of the ink pump includes impinging the wash liquid from spaced locations substantially surrounding the pump onto the external surfaces of the pump.

7. A method as set forth in claim 1 including injecting solvent into the first, second and third streams of wash liquid for a first predetermined cycle of the washing operation, and stopping the injecting of solvent during a second predetermined cycle of the washing operation while continuing to flow the wash liquid free of solvent.

8. A method as set forth in claim 1, wherein the first, second and third streams of wash liquid are derived from a common supply conduit connected to the source of wash liquid under pressure and the washing operation includes injecting solvent into the common supply conduit during a first predetermined cycle while simultaneously flowing the first, second and third streams and stopping the solvent injection during a second predetermined cycle of the washing operation while continuing to flow the wash liquid free of solvent.

9. A method as set forth in claim 1, wherein including the step of sensing wash liquid flow to the press fountain and stopping the operation of the press in the absence of a sensed wash liquid flow.

10. A method of washing ink from elements of a printing press having an ink pump adapted to be at least partially submerged in a reservoir of ink and to deliver ink through conduit supply means to a press fountain operable to distribute ink during printing operation, collector pan means for receiving excess ink delivered to the fountain, and conduit return means connected to the collector pan means for removing excess ink therefrom during printing operation comprising a washing operation including;

(a) providing a source of wash liquid under pressure;

(b) disconnecting the ink pump from the reservoir of ink;

(c) flowing a first stream of wash liquid into the press fountain while operating the press to distribute the first stream of wash liquid in a cocurrent ink flow direction to effect washing of the fountain and those elements of the press downstream of the fountain which are normally contacted by ink during printing operation;

(d) flowing a second stream of wash liquid in a countercurrent ink flow direction through the conduit supply means and into the ink pump while it is operating to effect washing of the internal surfaces of the conduit supply means and the ink pump; and (e) spraying a third stream of wash liquid onto the external surfaces of the ink pump which are normally submerged in ink during printing operation.

11. A method as set forth in claim 10 including simultaneously flowing the first, second and third streams of wash liquid without recirculation thereof whereby the streams of wash liquid contact the elements of the press in a single washing pass and are then discharged.

12. A method as set forth in claim 11 including diverting a portion of the second stream of wash liquid to provide the third stream of wash liquid.

13. A method as set forth in claim 12, wherein the printing press includes an ink filter in the conduit supply means intermediate the ink pump and the press fountain, ink filter return line means adapted to return excess ink delivered to the filter to the ink reservoir during printing operation, and the step of diverting a portion of the second stream includes passing the diverted portion of the second stream through the ink filter return line means to a shower head means.

14. A method as set forth in claims 10 or 11 including injecting solvent into the first, second and third streams of wash liquid for a first predetermined cycle of the washing operation, and stopping the injecting of solvent during a second predetermined cycle of the washing operation while continuing to flow the wash liquid free of solvent.

15. A method as set forth in claim 10, wherein the first, second and third streams of wash liquid are derived from a common supply conduit connected to the source of wash liquid under pressure and the washing operation includes injecting solvent into the common supply conduit during a first predetermined cycle while simultaneously flowing the first, second and third streams and stopping the solvent injection during a second predetermined cycle of the washing operation while continuing to flow the wash liquid free of solvent.

16. An apparatus for washing ink from elements of a printing press having an ink pump adapted to be at least partially submerged in a reservoir of ink and to deliver ink through conduit supply means to a press fountain operable to distribute ink during printing operation, collecting pan means for receiving excess ink delivered to the fountain and conduit return means for removing the excess ink therefrom during printing operation comprising a source of wash liquid under pressure, conduit flow means for flowing wash liquid:

(a) to the fountain while the printing press is being operated for distribution of the wash liquid to the collector pan means and the conduit return means in a cocurrent ink flow direction;

(b) through the conduit supply means and into the ink pump in a countercurrent ink flow direction while the ink pump is being operated; and (c) to shower head means for spraying wash liquid onto the external surfaces of the ink pump.

17. An apparatus as set forth in claim 16 including solvent injector means adapted to be connected to a source of solvent and to inject solvent into the wash liquid flowing in the conduit flow means during a first predetermined cycle and to stop the injection of solvent during a second predetermined cycle while allowing the continued flow of wash liquid free of solvent.

18. An apparatus as set forth in claim 17, wherein the conduit flow means comprise a first conduit for passing a first stream of wash liquid from the source thereof to the fountain, first flow divider means for diverting a portion of the first stream of wash liquid to provide a second liquid stream of wash liquid passing to the conduit supply means and second flow divider means for diverting a portion of the second liquid stream to provide a third liquid stream of wash liquid passing to the shower head means.

19. An apparatus as set forth in claim 18, wherein the second flow divider means comprises an ink filter mounted in the conduit supply means between the ink pump and the fountain, the ink filter including an ink return line for returning excess ink delivered to the filter to the reservoir through the shower head means.

20. An apparatus as set forth in claim 16, including an electronic control to regulate the flow of wash liquid through said conduit flow means by operation of valve means and to regulate the operation of the printing press and ink pump in accordance with the flow of wash liquid during a predetermined washing cycle.

21. An apparatus as set forth in claim 16, including solvent injector means adapted to be connected to a source of solvent and to inject solvent into the conduit flow means.

22. An apparatus as set forth in claim 21, including an electronic control to regulate the flow of wash liquid through the conduit flow means by operation of valve means and to regulate the operation of the printing press and ink pump in accordance with the flow of wash liquid during a predetermined washing cycle.

23. An apparatus as set forth in claim 22, wherein the electronic control regulates the solvent injector means to inject solvent into the wash liquid flowing in the conduit flow means during a first predetermined period of said washing cycle and to stop the injection of solvent during a second predetermined cycle while allowing the continued flow of wash liquid free of solvent during a second predetermined period of said washing cycle.

24. An apparatus as set forth in claim 23, wherein the electronic control includes a first timing relay to control the operation of the solvent injector means during the first predetermined period, and a second timing relay to control the flow of wash liquid and the operation of the printing press and ink pump during the second predetermined period, the first timing relay having a shorter timing period than the second timing relay, each of the timing periods beginning at the same time.

25. An apparatus as set forth in claim 16 or 21 including flow responsive means in the conduit flow means to sense the flow of wash liquid and to interrupt the operation of the printing press in the absence of wash liquid flow.

26. An apparatus as set forth in claim 16 or 21, wherein the shower head means include a continuous conduit having spray apertures through its wall and extending around the pump for impinging wash liquid on the external surface of the pump.

27. An apparatus as set forth in claim 16 or 21, wherein the ink pump is integrally mounted to a cover for the reservoir of ink and the shower head means comprises a continuous conduit having apertures through its wall and mounted to the cover on the side thereof adjacent to the pump and at a location above the external surfaces of the pump which are normally submerged in ink during printing operation.

28. An apparatus as set forth in claim 16, wherein the ink pump, conduit supply means, press fountain, collector pan means and conduit return means provide a first printing station of the press, the press includes a second printing station having a second shower head means for spraying wash liquid onto the external surfaces of the second ink pump of the second printing section, and the conduit flow means are adjustable to flow wash liquid to the first or second printing station of the press.

* * * * *

UNITED STATES PATENT AND TRADEMARK OFFICE

CERTIFICATE OF CORRECTION

PATENT NO. : 4,534,291

DATED : August 13, 1985

INVENTOR(S) : James J. Sobota et al.

It is certified that error appears in the above-identified patent and that said Letters Patent are hereby corrected as shown below:

On the first page of the patent:

Section [76] Inventors - "James J. Sabota" should read

--James J. Sobota--.

Signed and Sealed this

*Third* Day of *December 1985*

[SEAL]

*Attest:*

DONALD J. QUIGG

*Attesting Officer* *Commissioner of Patents and Trademarks*